US007537547B1

(12) United States Patent
Hosick et al.

(10) Patent No.: US 7,537,547 B1
(45) Date of Patent: May 26, 2009

(54) FOREARM SUPINATION DEVICE FOR BICEP MUSCULATURE DEVELOPMENT

(76) Inventors: Colton D. Hosick, 71096 Rd. 384, McCook, NE (US) 69001; Albert W. Gebhard, 2101 E. Alameda, Denver, CO (US) 80209

( * ) Notice: Subject to any disclaimer, the term of this patent is extended or adjusted under 35 U.S.C. 154(b) by 0 days.

(21) Appl. No.: 11/197,104

(22) Filed: Aug. 4, 2005

Related U.S. Application Data

(60) Provisional application No. 60/599,702, filed on Aug. 5, 2004.

(51) Int. Cl.
*A63B 21/045* (2006.01)
*A63B 21/055* (2006.01)
*A63B 23/12* (2006.01)

(52) U.S. Cl. ..... 482/45; 482/124

(58) Field of Classification Search ..... 482/44–50, 482/92, 97, 121, 122, 124, 127, 139; 601/40; 602/21, 1
See application file for complete search history.

(56) References Cited

U.S. PATENT DOCUMENTS 2,819,081 A * 1/1958 Touraine ..... 482/45
3,495,824 A * 2/1970 Cuinier ..... 482/113
3,592,467 A * 7/1971 Pereira ..... 482/126
4,239,208 A * 12/1980 Walls ..... 482/46
4,258,913 A * 3/1981 Brentham ..... 482/45
4,373,717 A * 2/1983 Lambert, Jr. ..... 482/45
4,540,173 A 9/1985 Hopkins, Jr.
4,570,925 A * 2/1986 Kock et al. ..... 482/46
4,822,027 A * 4/1989 Kascak ..... 482/46
4,836,531 A * 6/1989 Niks ..... 482/44
4,896,880 A 1/1990 Caruthers
4,949,957 A 8/1990 Cucchiara
5,042,799 A 8/1991 Stanley
5,088,731 A 2/1992 Carpenter
5,110,119 A 5/1992 Arnold
5,275,174 A 1/1994 Cook
5,350,345 A 9/1994 Frey
5,364,323 A * 11/1994 Liu ..... 482/45
5,518,480 A 5/1996 Frappier
5,569,124 A * 10/1996 Raynie et al. ..... 482/44
5,607,378 A 3/1997 Winston
5,662,595 A * 9/1997 Chesher et al. ..... 602/20
5,665,040 A * 9/1997 Ho ..... 482/126

(Continued)

OTHER PUBLICATIONS

Bodies Web Site, Training Bodies Building Lives Newsletter printout of article "Supination On Dumbell Curls!", by Nick Nilsson at Fitstep.com dated 8/2/1005 and attached hereto.

(Continued)

*Primary Examiner*—Loan H Thanh
*Assistant Examiner*—Victor K Hwang
(74) *Attorney, Agent, or Firm*—Margaret Polson; Polson & Associates, PC

(57) ABSTRACT

A bicep exercising device has a frame with a housing, and a elbow cradle to hold the elbow in a chosen flexed position. The elbow cradle is adjustably attached to a frame and a rotatable handle grip. This allows for comfortable position of the hand in a palm down position and the elbow in a flexed position between about 179 degrees and 15 degrees. The handle rotates 180 degrees or more, thus allowing for full supination of the forearm. Using a supination motion of the forearm a user can exercise the bicep muscle.

18 Claims, 7 Drawing Sheets

U.S. PATENT DOCUMENTS

| | | | | |
|---|---|---|---|---|
| 5,713,370 | A | 2/1998 | Cook | |
| 5,738,636 | A * | 4/1998 | Saringer et al. | 601/5 |
| 5,759,165 | A * | 6/1998 | Malewicz | 602/21 |
| 5,951,499 | A * | 9/1999 | Saringer et al. | 601/33 |
| 6,004,281 | A * | 12/1999 | Harbin et al. | 600/595 |
| 6,171,221 | B1 | 1/2001 | Hayduk | |
| 6,179,799 | B1 * | 1/2001 | Doran | 602/20 |
| 6,241,643 | B1 | 6/2001 | Loft et al. | |
| 6,264,589 | B1 * | 7/2001 | Chen | 482/139 |
| 6,296,598 | B1 | 10/2001 | Boland | |
| 6,340,341 | B1 | 1/2002 | Purcell | |
| 6,497,640 | B2 | 12/2002 | Loft et al. | |
| 6,506,172 | B1 * | 1/2003 | Hepburn et al. | 601/5 |
| 6,565,493 | B1 | 5/2003 | Geh | |
| 6,740,051 | B2 * | 5/2004 | Hepburn et al. | 601/5 |
| 6,921,352 | B1 * | 7/2005 | Stearns | 482/44 |
| 2002/0013201 | A1 | 1/2002 | Loft et al. | |
| 2003/0125651 | A1 * | 7/2003 | Hopkins et al. | 602/20 |
| 2003/0209248 | A1 * | 11/2003 | Berger et al. | 128/845 |
| 2005/0164852 | A1 | 7/2005 | Vandyke | |

OTHER PUBLICATIONS

Http://www.topendsports.com/fitness/technique-curles.htm, print-out of Fitness Training article, "Get a Grip! Squeeze more results from every single rep of your dumbell curls", by Nick Nilsson dated Aug. 2, 2002 and attached hereto.

Printout of web article "Secret Training Tip #149—Get a Grip!, Squeeze more results from every single rep of your Dumbell curls just by changing how you hold them", by Nick Nilsson dated 8/2/1005 and attached hereto.

* cited by examiner

FOREARM SUPINATION DEVICE FOR BICEP MUSCULATURE DEVELOPMENT

CROSS REFERENCE APPLICATIONS

This application is a non-provisional application claiming the benefits of provisional application No. 60/599,702, filed Aug. 5, 2004.

BACKGROUND

It can be appreciated that bicep development devices have been in use for years. Typically, bicep development devices use free weights and/or captive weight machines. The most common method of training the bicep musculature include dumbbell and barbell curls (free weight) through the movement of elbow flexion. Perhaps as much as 98% of bicep training is accomplished through this method using free weights.

In addition, large weight machines which utilize cables/pulleys and/or weight stacks (captive weight) to provide resistance are often used. One common machine of this type is known as the 'Preacher Curl Machine.' The method used to train the bicep musculature in all cases is elbow flexion working against a resistance (weight).

The main problem with conventional bicep development devices is the method of training the bicep musculature and the inconvenience of the equipment required. The only significant improvement of the means of bicep development occurred with the introduction of the captive weight machines with a grip the user grasps and moves to accomplish the elbow flexion to exercise the bicep in a traditional manner.

These machines are safer than free-weights because the user (perhaps very young, inexperienced or elderly) cannot accidentally lose control and drop a heavy object on himself or a bystander. However, the weight machine is large and not easily moved from place to place. It is also more costly and complicated than most users find desirable.

Another problem with conventional bicep development devices are the movement of a curl or elbow flexion requires supplemental stabilization support by the shoulder girdle musculature. This can be a limiting factor in training the bicep musculature if the shoulder girdle (rotator cuff) musculature is weak or injured. Conversely, it is possible to injure the shoulder girdle musculature when performing weighted arm curls with free weights. Repeated elbow flexion can also lead to chronic epicondylitis (tennis elbow).

Supination is the movement of the radius bone around the ulna bone so the anterior surface of the forearm is turned. This action begins with the palm in the inferior position and moves through the medial to the superior. Resistance during supination directly targets the bicep musculature including the biceps brachia muscle and the brachiaradialis muscle.

Supination can occur with a slightly flexed elbow to a fully flexed elbow. With the elbow flexed to some degree the palm is moved from an inferior position (palm down) through a medial position to finally a superior position (palm up). After maximal supination is accomplished, the forearm motion is reversed to bring the arm anatomy back to the starting position ready to repeat the motion again. If resistance to the rotation is provided, significant exercise of the bicep and other arm muscles can occur.

In these respects, a forearm supination device for bicep musculature development substantially departs from the conventional concepts and designs of the prior art, and in so doing provides an apparatus with a novel method of exercising the bicep (upper arm) musculature to enhance strength, girth and endurance.

The foregoing example of the related art and limitations related therewith are intended to be illustrative and not exclusive. Other limitations of the related art will become apparent to those of skill in the art upon a reading of the specification and a study of the drawings.

SUMMARY

An aspect of the present device is to provide a device using forearm supination for bicep musculature development.

Another aspect of the present disclosure to provide a method of developing bicep musculature.

Other aspects of this invention will appear from the following description and appended claims, reference being made to the accompanying drawings forming a part of this specification wherein like reference characters designate corresponding parts in the several views.

The present device has a stabilizing elbow cradle to hold the elbow in a chosen flexed position. The flexed position isolates the applied resistance to the biceps. This elbow cradle is adjustably attached to a frame, which has an ergonomically designed, rotatable handle grip. This system allows for comfortable position of the hand in a palm down position and the elbow in a flexed position between about 179 degrees and 15 degrees. The handle rotates 180 degrees or more, thus allowing for full supination of the forearm.

Adjustable resistance is provided between the rotatable handle grip and the main frame member in the depicted embodiment by a drum with adjustable resistance. The adjustable resistance can be provided in a number of ways.

The following embodiments and aspects thereof are described and illustrated in conjunction with systems, tool and methods which are meant to be exemplary and illustrative, not limiting in scope. In various embodiments, one or more of the above described problems have been reduced or eliminated, while other embodiments are directed to other improvements.

Figure 2:
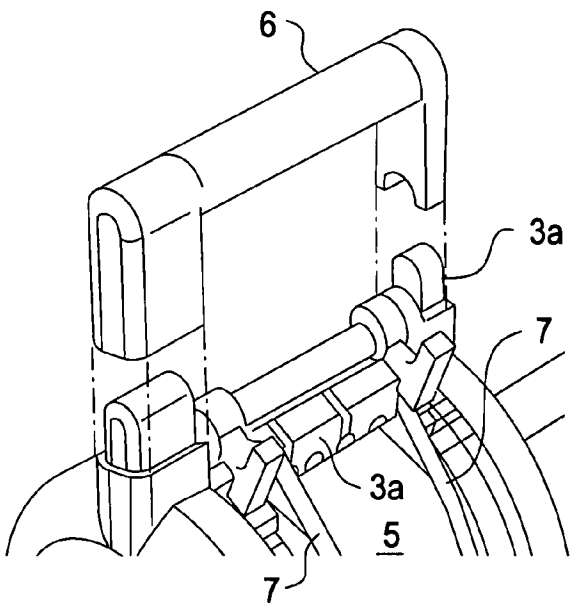
FIG. 2 is an exploded view showing the handle removed.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

Various other aspects, features and attendant advantages of the present disclosure will become fully appreciated as the same becomes better understood when considered in conjunction with the accompanying drawings, in which like reference characters designate the same or similar parts throughout the several views, and wherein:

DETAILED DESCRIPTION OF THE DRAWINGS

Figure 1:
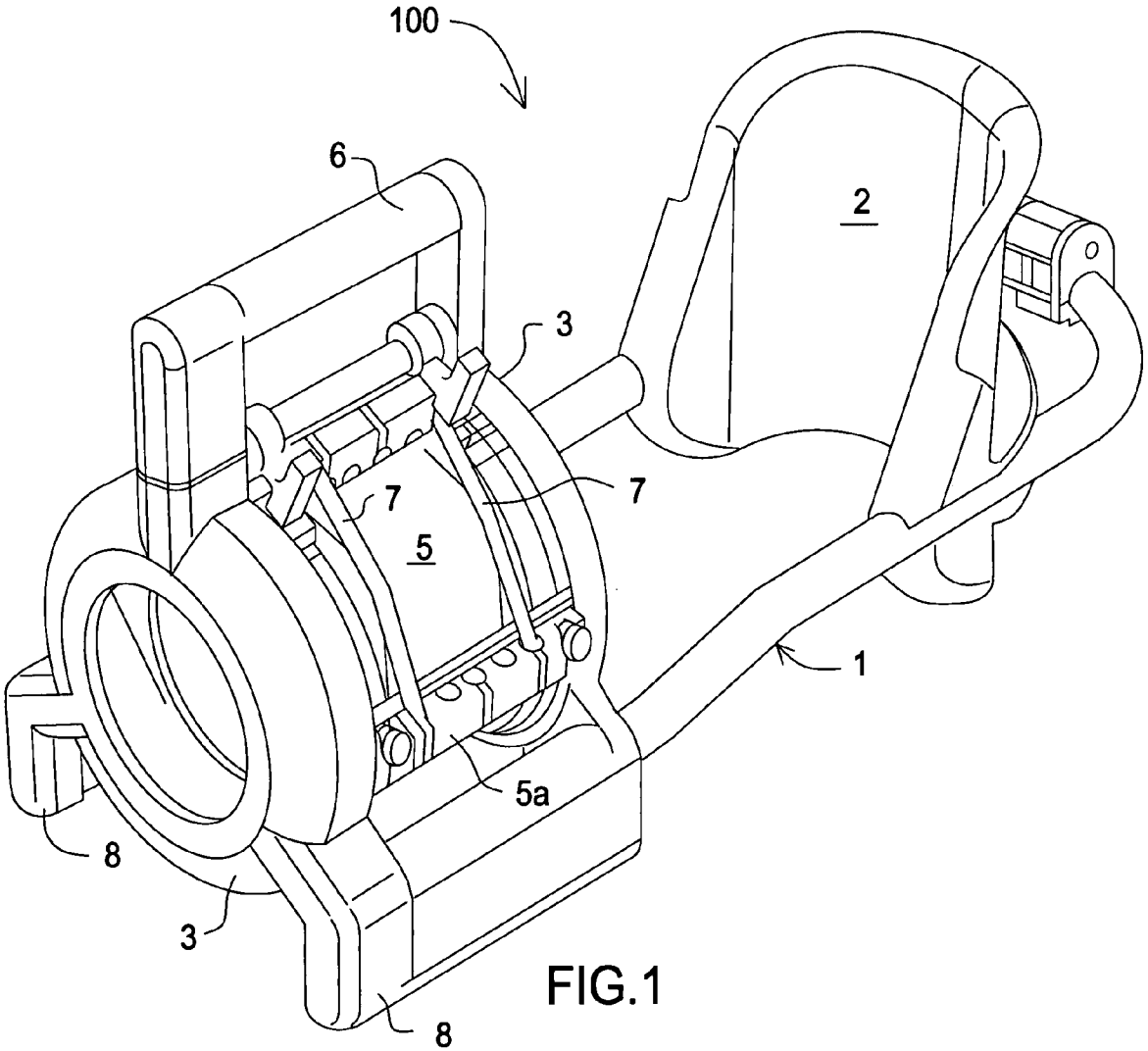
FIG. 1 is a top perspective view of an embodiment of the device.
Figure 3:
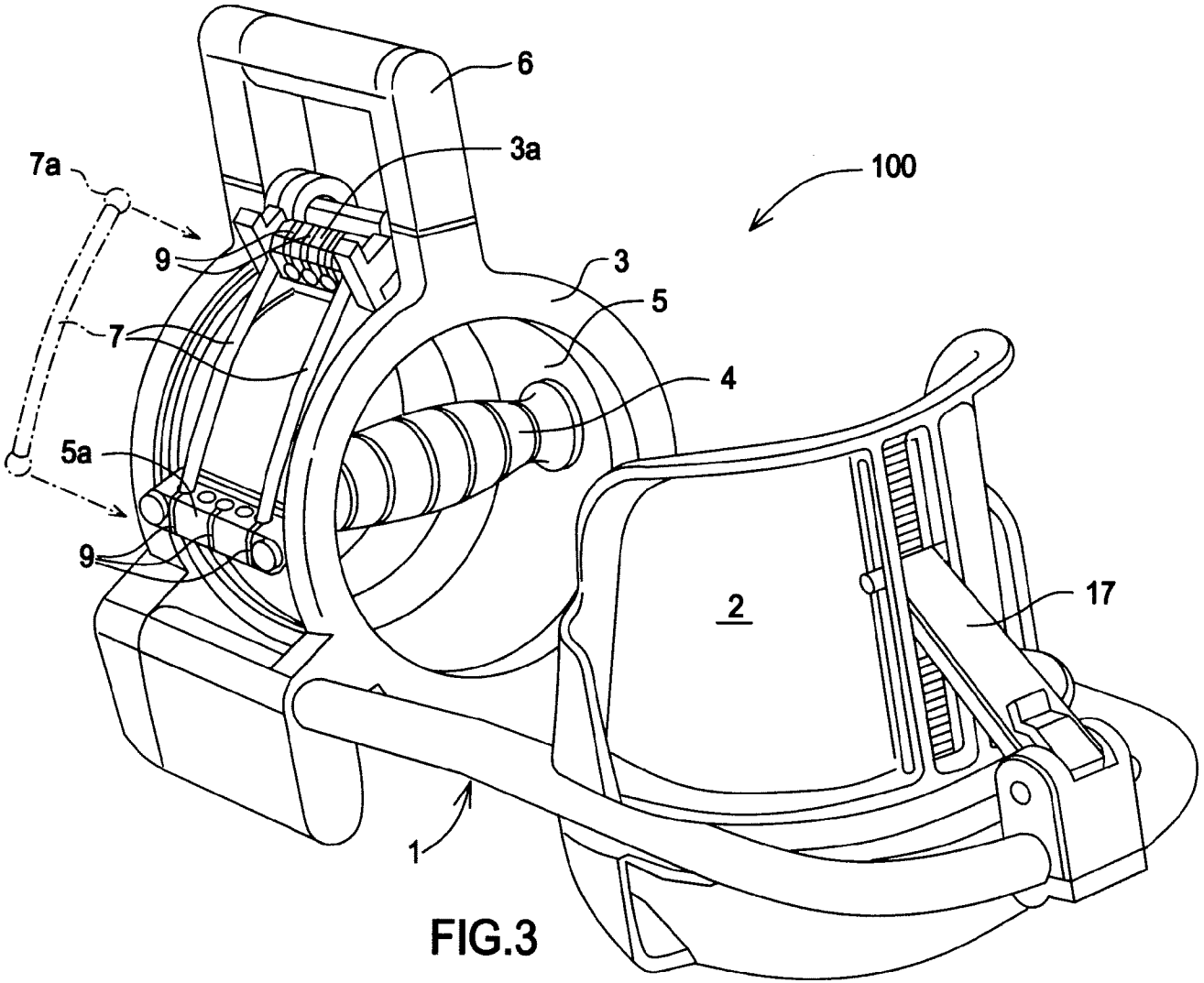
FIG. 3 is back perspective view of FIG. 1.

Referring first to FIGS. 1, 2, and 3 a forearm exercise device 100 for bicep musculature development is shown. The exercise device has a frame 1, an elbow cradle 2, and a grip 4 attached to a cylinder 5 rotatably mounted within housing 3. The grip 4 can be formed for ergonomic comfort.

The exercise device 100 is size to allow a hand of the user to grasp the grip 4 and the elbow of the user to rest against the elbow cradle 2 with the elbow in a flexed position between 179 degrees and 15 degrees. In the depicted embodiment the elbow will be held at about 90 degrees. The grip 4 is mounted within cylinder 5, which rotates within housing 3, allowing for the supination of the forearm as the user rotates the grip 4 with their elbow in the elbow cradle 2.

Designs and materials may vary, but an important element of the design of the elbow cradle 2 is the minimization of movement of the elbow and retention of the elbow at an angle between 179 degrees and 15 degrees. For many users the optimum range is 85 degrees to 100 degrees of elbow bend. It is believed that most users will find the greatest bicep development with the elbow flexed at least 90 degrees. However, this will vary highly from user to user and depend on the exact type of conditioning desired. No limitation of the amount of elbow bend should be inferred other than the amount required to have the bicep muscle work during supination.

The resistance to rotation of the grip 4 within the housing 3 is adjustable to allow a range of users and exercise levels. The resistance could be provided by ratchets, pneumatic pressure, friction, springs (including compression, extension and torsion) with any necessary reconfiguration of the supporting structures. Likewise various types of elastic material resistance could be adapted including: bands, cords molded or extruded rods or shapes, sheets straps and loops. Although more complicated, torsion rods of various materials could also be adapted and with appropriate reconfiguration could provide resistance to the rotation of a handle.

In the depicted embodiment of FIGS. 1, 2 and 3 adjustable resistance is provide by elastic bands 7 attached to the cylinder 5 at attachment 5*a* and the housing 3 at attachment 3*a*. The elastic bands 7 have nubs 7*a* at each end, shown in dotted lines, to hold them in place in slots 9 of attachments 3*a*, 5*a*. Elastic bands 7 with a variety of stiffness can be provided. The users can add or remove elastic bands 7 to achieve the desired level of resistance. A resistance means that can be easily changed allows for ease of use by a variety of people. The cylinder 5 has attachment 5*a* on each side, to allow the resistance to be provided for either direction of rotation. One direction of rotation would allow the user to exercise their right arm and the other direction would allow the user to exercise their left arm. In general, it is expected that a user will choose to have resistance in only one direction, however, if desired, there could be resistance in both directions.

A handle 6 can be provided on top of housing 3 to allow the user to stabilize the device 100 in use. Handle 6 can be removable, as shown in FIG. 2, for ease of storage or transport. Feet 8 can be provided on case 3 to allow the device 100 to be rested on a level surface during use or storage.

The grip can rotate at least 180 degrees against resistance to allow for full supination of the forearm in either direction. The housing 3 allows for easy and simple attachment of a resistance medium to provide the variable resistance for supination of the forearm and therefore exercise of the bicep.

The elbow cradle 2 can be adjustably mounted on frame 1, as shown in FIG. 3, to allow for different users. Ratchet 17 is attached to the frame 1 and to the back of cradle 2. Ratchet 17 works in a known manner to lock elbow cradle 2 in the desired position. Other known means of making the elbow cradle 2 adjustable would function as well. This includes spring pawls on ratchet teeth in the frame 1 or threaded thumb screws through the elbow cradle 2 engaging with or on the frame 1 or any manner of friction lock creating a releasable positioning means between the elbow cradle 2 and the frame 1.

Many means known to one skilled in the art may be used to connect the rotational movement of the grip 4 during the necessary supination of the forearm to the resistance medium. The exact design for attachment of the resistance medium will depend upon the medium chosen.

One of the advantages of the supination method of the biceps exercise is that the shoulder joint of the user does not have to be used at all. The user can set the device 100 on a table so that no weight is born by the shoulder joint. This allows users to largely isolate the bicep from the shoulder joint, for either injury or training reasons.

Figure 4:
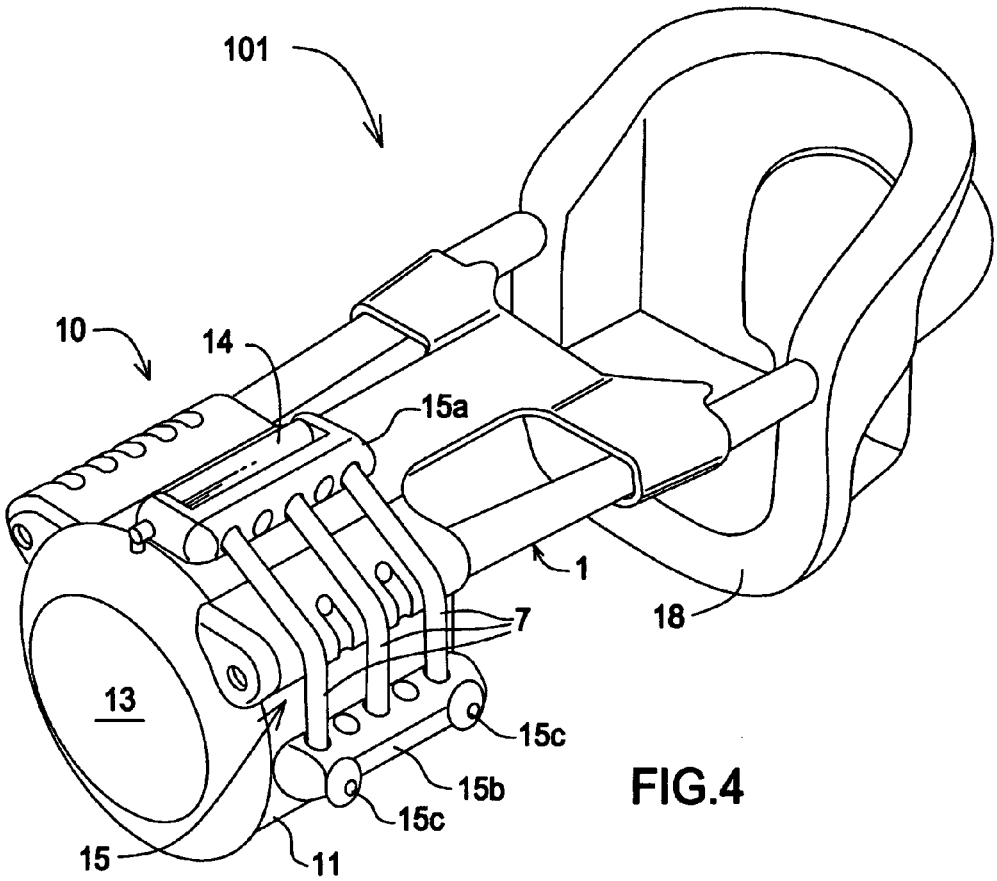
FIG. 4 is top perspective view an alternate embodiment.
Figure 5A:
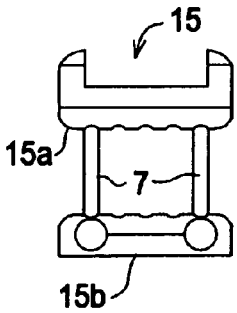
FIGS. 5*a*-5*d* a top plan views of the resistance.
Figure 5B:
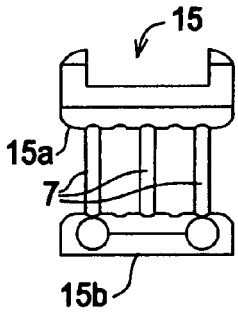
Figure 5C:
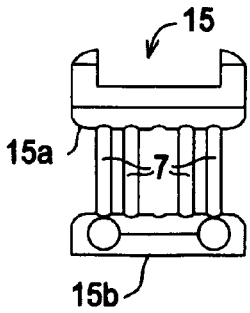
Figure 5D:
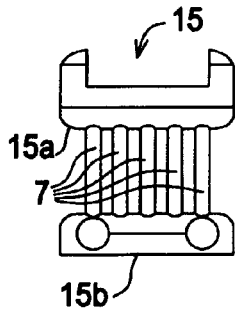
Figure 6:
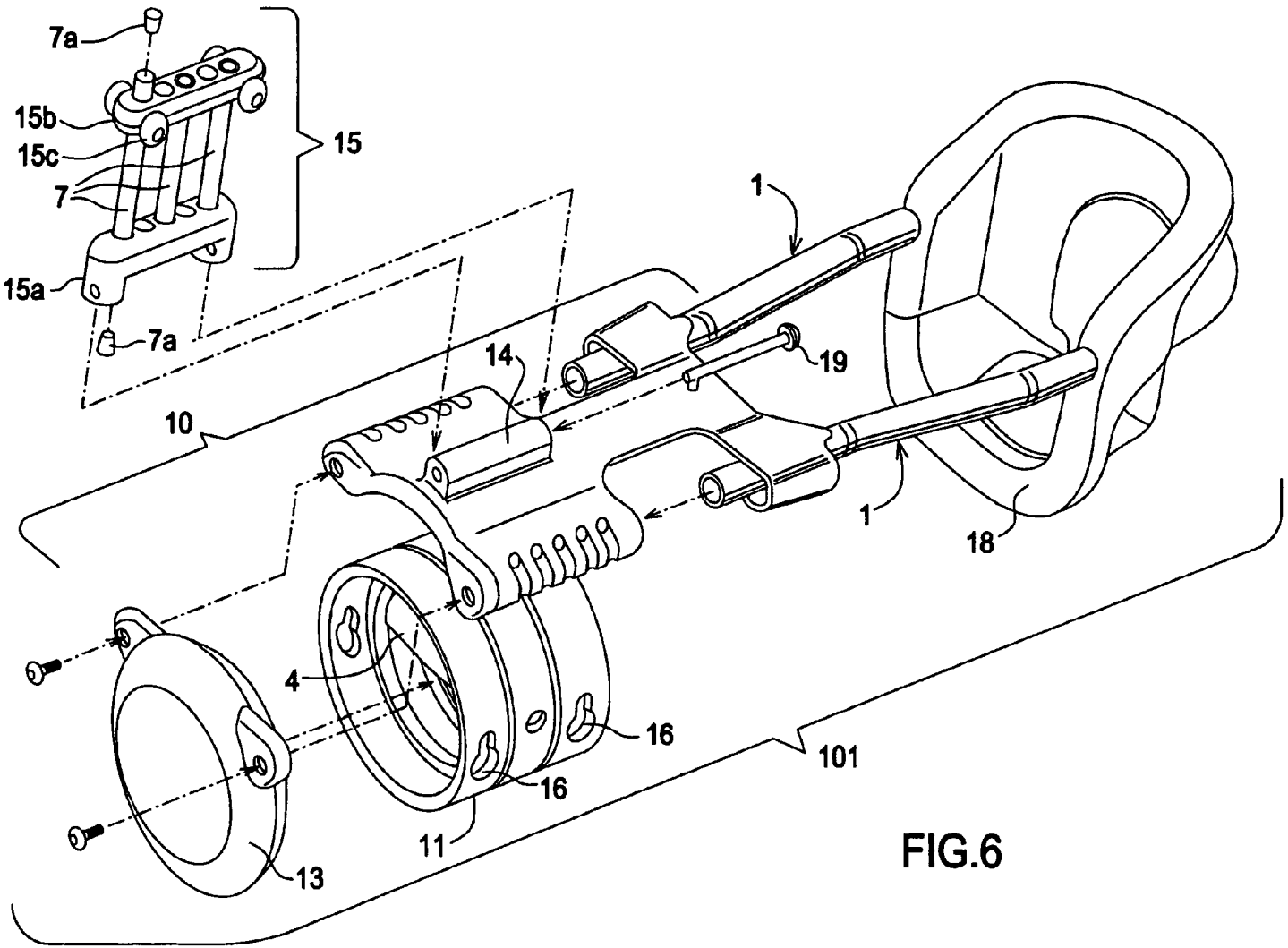
FIG. 6 is an exploded view of the alternate embodiment.

An alternate embodiment of the device 101 is shown in FIGS. 4, 5 and 6. Front assembly 10 is fixed to the frame 1 and supports the drum 11 that rotates inside. Resistance cassette 15 attached to the front assembly 10 and the drum 11 to provide resistance. Grip 4 is mounted inside drum 11. Frame 1 also supports the elbow cradle 13, which can also be adjustable.

Front cover 13 closes and provides support to the front assembly 10 and drum 11. Any method appropriate to allowing the grip 4 and its support and attachment to resistance and rotation to move as described herein may be substituted.

Anchor block 14 provides attachment point for a resistance cassette 15 to the front assembly 10, which is attached with pin 19 at the top 15*a* of resistance cassette 15, as shown in FIG. 6. The bottom 15*b* of the cassette has knobs 15*c* to attach on drum 11 by sliding into holes 16. Holes 16 have a wide bottom section and narrow top to hold knobs 15*c* in a known manner. Elastic bands 7 extend between the top 15*a* and the bottom 15*b* and are held in place with nub 7*a*. In the alternative, circular elastic bands could also be used, and attach onto hooks or similar attachment points. Depending on which arm is being exercised, the resistance cassette 15 can reverse from left to right on the front assembly 10 provide resistance in the proper direction. If other resistance means is employed, the termination and attachment of that means would depend on that specific design and are not material.

Figure 7:
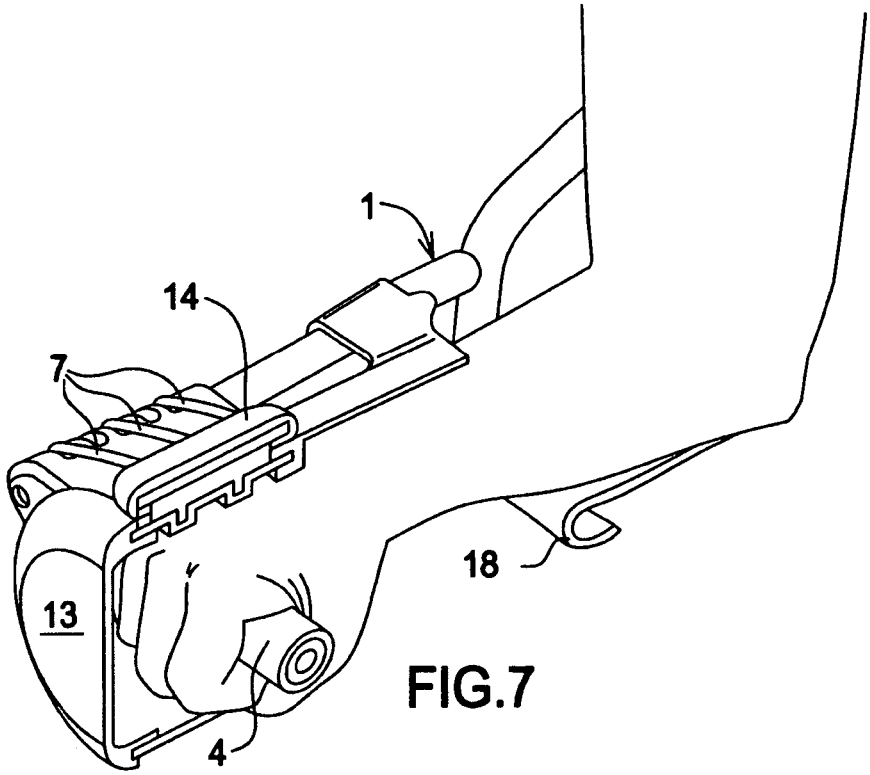
FIG. 7 is a cut-away view of the start position.
Figure 8:
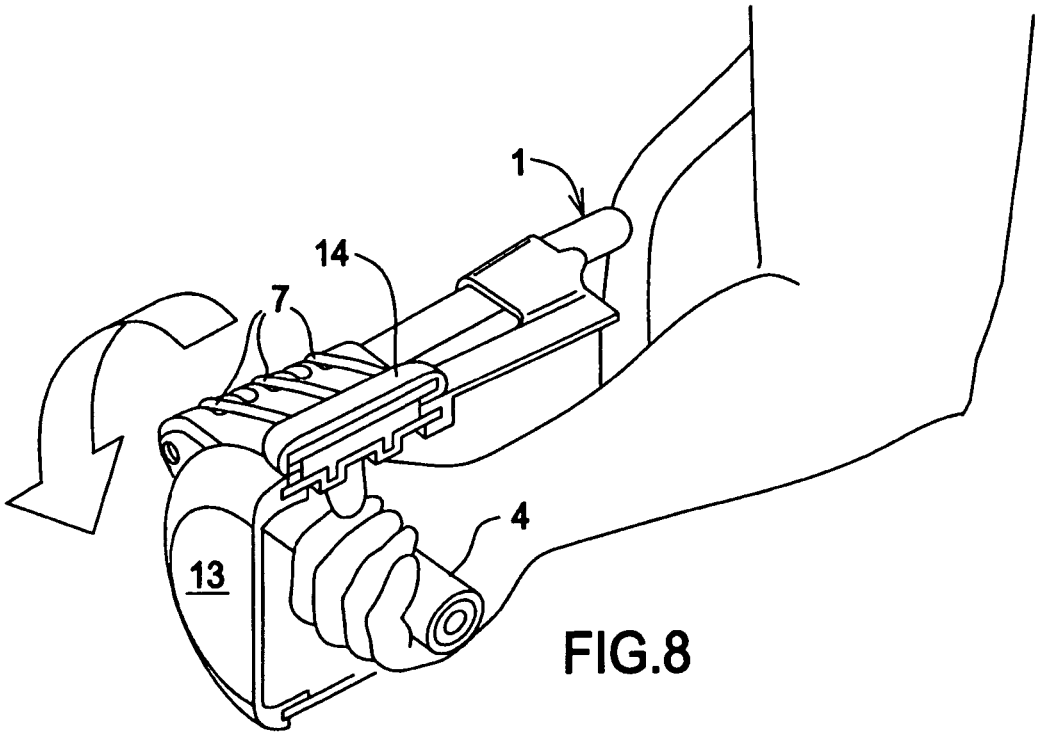
FIG. 8 is cut-away view of the finish position.
Figure 9:
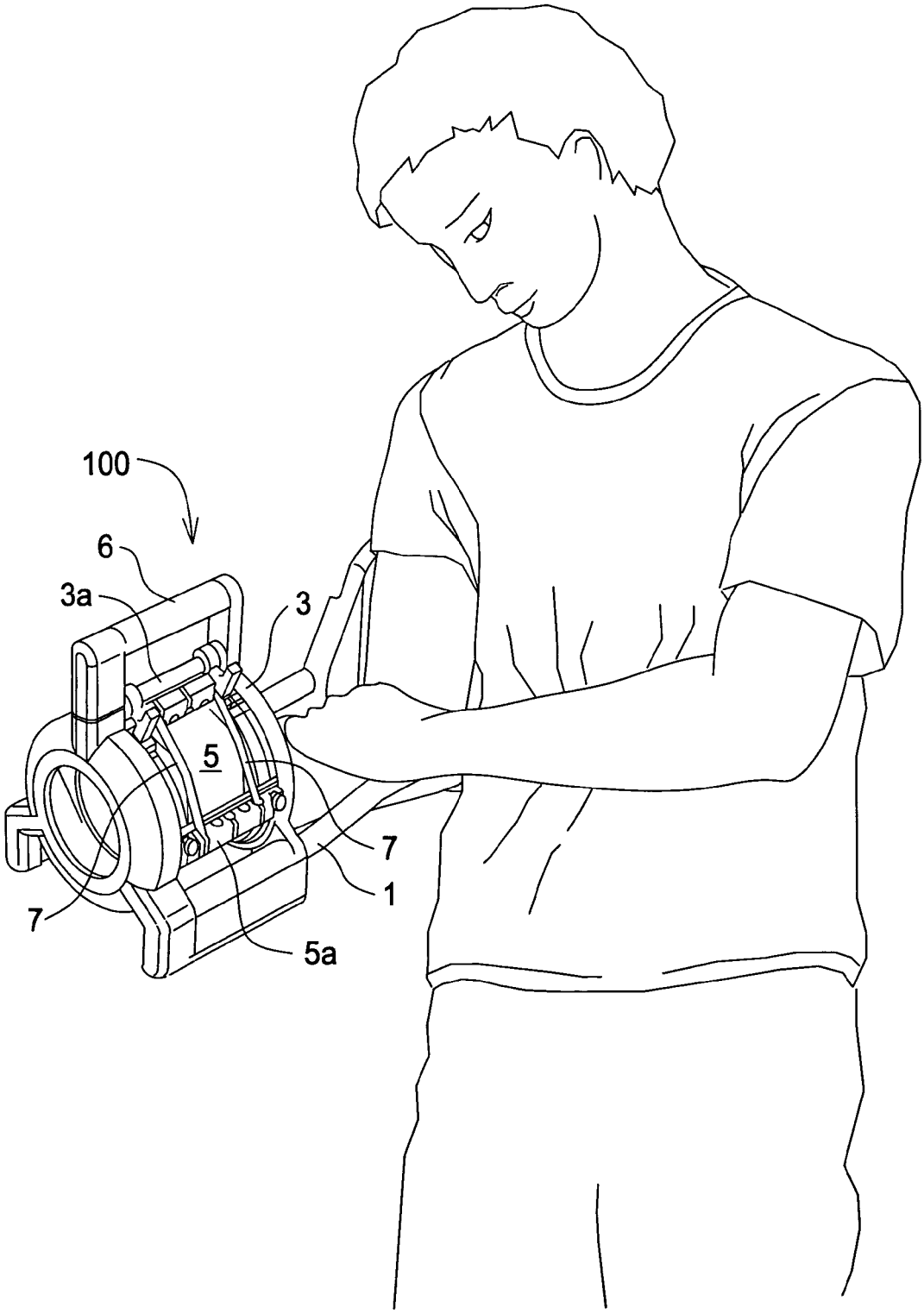
FIG. 9 is a front perspective view of the device in use.

In use, the hand of the arm being exercised grasps the grip 4 inside the front assembly 10 with the palm down, as shown in FIG. 7. The grip 4 is turned from a palm down position through a full rotation of the user's forearm to the palm up position shown in FIG. 8. In most users this rotation will be about 180 degrees. Greater or lesser amounts of rotation may occur with different users. The user then rotates the hand back to the palm down position, and then repeats as desired. The other arm may then be exercised with a appropriate re-configuration of the resistance.

An important element of design of any of the embodiment of the forearm exercise device 100 is the linear connection of rotational handle system with resistance to an elbow support that provides a particular angle of the elbow. Many possible materials, constructions, and details could accomplish this.

Figure 10:
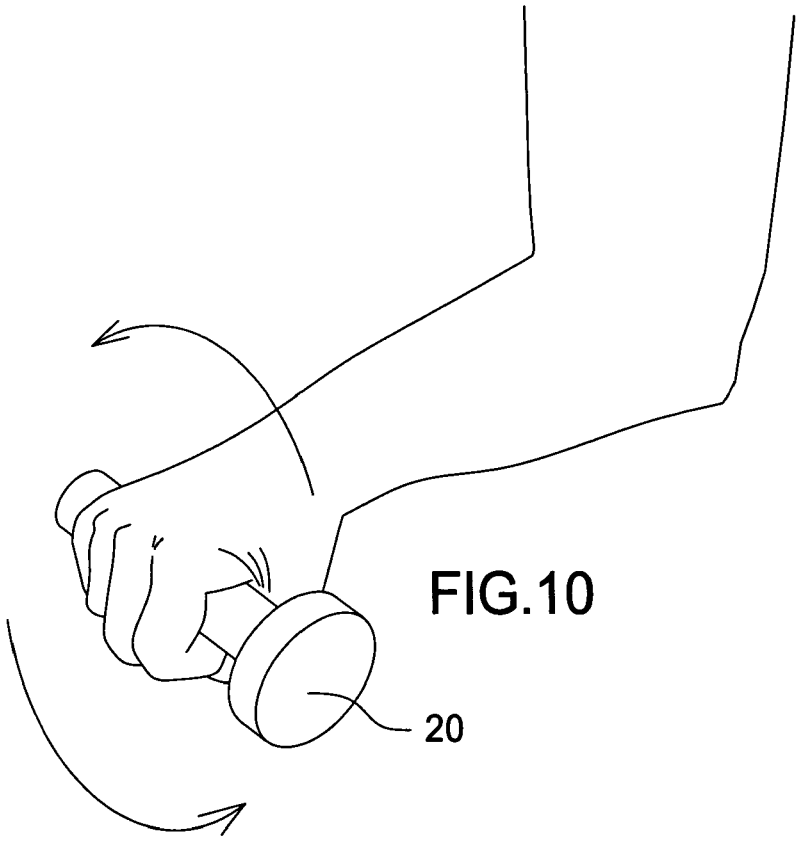
FIG. 10 is a front perspective view of a user performing the method with a free weight.
Figure 11:
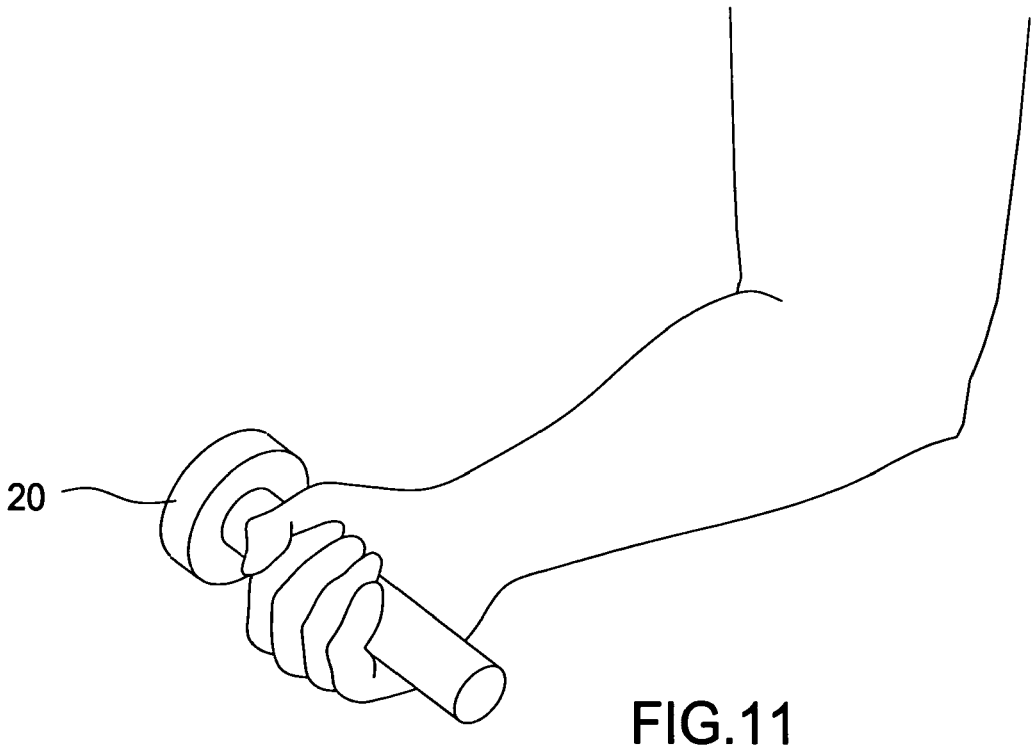
FIG. 11 is a front perspective view of a user performing the method with a free weight.

The method of exercising the bicep described above can be practiced without the above described device. Referring next to FIG. 10 the user can grasp a weight 20 in the palm down position. In the depicted embodiment, the weight is off centered, with more weight on the thumb side of the hand, to provide greater resistance to supination. The hand in then rotated to the palm up position shown in FIG. 11.

This method could also be practiced with an elastic band with a handle attached to a fixed position or any similar method to provide resistance to the rotation of the wrist.

Construction and material may be varied depending on a variety on factors, and are not considered important.

With respect to the above description then, it is to be realized that the optimum dimensional relationships for the parts of the device, to include variations in size, materials, shape, form, function and manner of operation, assembly and use are deemed readily apparent and obvious to one skilled in the art, and all equivalent relationships to those illustrated in the drawings and described in the specification are intended to be encompassed by the present disclosure.

Although the present device has been described with reference to the disclosed embodiments, numerous modifications and variations can be made and still the result will come within the scope of the invention. No limitation with respect to the specific embodiments disclosed herein is intended or should be inferred. Each apparatus embodiment described herein has numerous equivalents.

We claim:

1. A bicep exercise device comprising:

a frame having a housing and an elbow cradle attached at opposing ends of said frame a cylinder rotatably mounted within the housing, the cylinder having a substantially solid outer surface and a grip inside said cylinder;

the grip and the elbow cradle being in linear relation to each other to allow a user to rest their elbow in the elbow cradle and hold the grip in a hand;

the cylinder being adapted to move in a given direction a given distance from a first position to a second position when the user presses on the grip with the hand and to move in the opposite direction back to the first position when the user is no longer pressing on the grip;

the first position the hand being in either a substantially palm up or a substantially palm down position, the second position being the opposite position;

the cylinder having a resistance to rotation within said housing through substantially all of the given distance when moving the first direction, said resistance to rotation increasing substantially continuously during the movement to the second position;

said resistance to rotation functioning to move the cylinder back to the first position when the user is no longer pressing on the grip;

the resistance to rotation being in the given direction such that the bicep of the user is exercised when the user presses the grip and rotates the cylinder from the first position to the second position.

2. The bicep exercise device of claim 1 wherein the resistance comprises:

an elastic band removably attached to the cylinder and the housing.

3. The bicep exercise device of claim 1 wherein the resistance comprises:

a cassette having one or more elastic bands, said cassette being removably attached to the cylinder and the housing.

4. The bicep exercise device of claim 1, further comprising the elbow cradle being slideably attached to the frame, wherein the distance between the grip and the elbow cradle can be changed to fit a given user.

5. The bicep exercising device of claim 1 wherein the resistance to rotation is attached to the outer surface of the cylinder.

6. The bicep exercising device of claim 5 wherein the frame is not attached to the user's arm.

7. The bicep exercising device of claim 6 wherein the grip is not attached to the users hand.

8. The bicep exercising device of claim 5 wherein the grip is not attached to the users hand.

9. The bicep exercising device of claim 1 wherein the frame is not attached to the user's arm.

10. The bicep exercising device of claim 1 wherein the grip is not attached to the users hand.

11. A bicep exercising means comprising:

a frame having a housing and an elbow cradle attached at opposing ends of said frame a rotation means being a cylinder having a substantially solid outer surface with a grip mounted inside;

the grip and the elbow cradle being in linear relation to each other to allow a user to rest their elbow in the elbow cradle and hold the grip in a hand;

the rotation means functioning to have a resistance to rotation;

the rotation means being adapted to move against a resistance means, said resistance means functioning to cause the rotation means to have a increasing resistance to the movement in a given direction a given distance from a first position to a second position when the user presses on the grip with the hand and to move in the opposite direction back to the first position when the user is no longer pressing on the grip;

the first position the hand being in either a substantially palm up or a substantially palm down position, the second position being the opposite position;

the increasing resistance being substantially continuous in the first direction of rotation;

said resistance means further functioning to bias the rotation means to return to substantially the first position when the users hand is no longer pressing on the grip;

the resistance to rotation being in the given direction such that the bicep of the user is exercised when the user presses the grip and rotates the rotation means from the first position to the second position.

12. The bicep exercising means of claim 11 further comprising:

the resistance to rotation attached to the solid outer surface of the cylinder.

13. The bicep exercising means of claim 12 wherein the frame is not attached to the user's arm.

14. The bicep exercising means of claim 13 wherein the grip is not attached to the user' hand.

15. The bicep exercising means of claim 12 wherein the grip is not attached to the user's hand.

16. The bicep exercising means of claim 11 wherein the frame is not attached to the user's arm.

17. The bicep exercising means of claim 16 wherein the grip is not attached to the user's hand.

18. The bicep exercising means of claim 11 wherein the grip is not attached to the user's hand.

* * * * *